US007770319B2

(12) United States Patent
McDonald

(10) Patent No.: US 7,770,319 B2
(45) Date of Patent: Aug. 10, 2010

(54) ROTATABLE GUN REST

(76) Inventor: Daniel E. McDonald, 268 Blackstone Camp Rd., North Augusta, SC (US) 29842

( * ) Notice: Subject to any disclaimer, the term of this patent is extended or adjusted under 35 U.S.C. 154(b) by 602 days.

(21) Appl. No.: 11/735,587

(22) Filed: Apr. 16, 2007

(65) Prior Publication Data

US 2010/0170134 A1 Jul. 8, 2010

Related U.S. Application Data

(60) Provisional application No. 60/744,854, filed on Apr. 14, 2006.

(51) Int. Cl.
*F41A 23/00* (2006.01)

(52) U.S. Cl. ..... 42/94; 89/37.04; 248/281.11

(58) Field of Classification Search ..... 42/94; 89/37.01; D22/108; 248/281.11, 282.1, 248/278.1

See application file for complete search history.

(56) References Cited

U.S. PATENT DOCUMENTS 4,266,748 A * 5/1981 Dalton ..... 248/425
4,854,066 A 8/1989 Canterbury
4,862,940 A * 9/1989 Atchison ..... 160/67
4,937,965 A 7/1990 Narvaez
4,967,497 A * 11/1990 Yakscoe ..... 42/94
5,379,205 A * 1/1995 Peng ..... 362/430
5,626,322 A * 5/1997 Braun ..... 248/282.1
5,913,667 A * 6/1999 Smilee ..... 42/94
6,086,031 A 7/2000 Renfro
6,243,979 B1 * 6/2001 Seats et al. ..... 42/94
6,276,087 B1 8/2001 Singletary
6,283,428 B1 * 9/2001 Maples et al. ..... 248/282.1
6,629,380 B2 * 10/2003 Yeargin ..... 42/94
6,935,064 B1 * 8/2005 Thompson ..... 42/94
D515,168 S * 2/2006 Ruhland et al. ..... D22/108
7,066,435 B2 * 6/2006 Oddsen et al. ..... 248/220.43
7,188,445 B2 * 3/2007 Lehman ..... 42/94
7,341,068 B2 * 3/2008 Liu ..... 135/20.3
7,415,790 B1 * 8/2008 Ruhland et al. ..... 42/94
7,493,719 B2 * 2/2009 Lackey ..... 42/94
2004/0020097 A1 * 2/2004 Deros ..... 42/94
2004/0237372 A1 * 12/2004 Frye ..... 42/94
2007/0169391 A1 * 7/2007 Carpenter ..... 42/94
2009/0113779 A1 * 5/2009 Shipman et al. ..... 42/94

* cited by examiner

*Primary Examiner*—Benjamin P Lee
(74) *Attorney, Agent, or Firm*—Calhoun Thomas, III; Samuel Alexander Long, Jr.

(57) ABSTRACT

The invention is a device that allows a marksman to easily rotate and position a gun from the elevated position of a deerstand. The invention utilizes displaced parallel axes of rotation so that the marksman can maximize the mobility of the gun during shot selection while at the same time minimizing both noise and personal bodily displacement.

4 Claims, 4 Drawing Sheets

ROTATABLE GUN REST

RELATED APPLICATIONS

This application claims priority from U.S. Provisional Patent Application having Ser. No. 60/744,854 filed on Apr. 14, 2006.

FEDERALLY SPONSORED RESEARCH OR DEVELOPMENT

Not applicable.

REFERENCED OR INCORPORATED MATERIAL

Not applicable.

BACKGROUND OF INVENTION

The present invention relates to an adjustable, rotatable gun rest adapted for use in a deer stand or other tower structure above the ground. The basic concept of a gun rest is quite old in the art of firearms. Gun rests are commonly used to firmly support and hold a rifle or other firearm in order to avoid unwanted movement while the marksman prepares to fire and then fires the weapon. Such an aid allows the marksman to focus on aiming without being required to support the gun. Traditionally, such rests or supports permit the marksman to shoot with far greater accuracy than is possible when the rifle is held freely.

Likewise, the art of deerstands is quite old. Many types of deerstands exist from freestanding towers, to stands attached to trees, to stands that "climb" a tree. The common characteristic is that the marksman is positioned on a small platform some distance from the ground. Thus, the term deerstand will hereinafter be used to refer to all such elevated stands. The need for an adequate gun rest is as great or greater for the marksman positioned in the tight deerstand as it is for marksman firing in other situations. However, the art of gun rests designed for use in a deerstand situation is decidedly sparse and the few examples that exist are rather crude and respond poorly to the unique circumstances presented by hunting from an elevated stand such as a deerstand.

The typical ground mounted gun rest such as U.S. Pat. No. 4,854,066 to Canterbury provides rotation about a single axis. Such motion necessarily results in significant displacement by the body of the marksman in rotating and aiming the gun. In a tight deerstand situation, such movement is nearly impossible so a specially adapted gun rest for elevated stands is needed in the art.

The typical gun rest for an elevated deerstand is exemplified in U.S. Pat. No. 6,243,979 to Seats which envisions a bar frame mounted to a tree. In such a situation, the marksman rests the gun on a bar extending radially from the tree. In such a situation, the marksman is at a disadvantage because he must slide his gun around the bar in order to reposition it. This often produces excess noise and excess movement on the part of the marksman. Such movement could also potentially damage the gun. Additionally, the bar invention provides no preferable angle towards the ground and contacts the gun at many different points depending on the target and the aim of the marksman.

Thus, there exists a need in the art for an improved gun rest that achieves the advantages of ground mounted gun rests in an elevated deerstand setting with near silent operation. The present invention addresses these long felt needs.

SUMMARY OF THE INVENTION

It is therefore an object of the invention to provide a gun rest that produces only limited noise, gives the marksman high gun mobility for shot selection with minimal personal displacement, and is implementable in the unique setting of a deerstand.

It is further the object of this invention to provide a gun rest that is simple to use, is extremely lightweight and durable, is accommodating of various human disabilities, is accommodating of both right and left hand users, and is relatively inexpensive to manufacture. The light weight of the invention is especially important when relating to the portability feature of the invention.

Briefly, in order to accomplish the above and other features that may become apparent, the invention utilizes several points of parallel axis rotation to provide mobility of a gun positioned on the gun rest. The base is adaptable and can be positioned on a number of different types of deerstands. Because of the ease of rotation and unique parallel axis design, the disabled, such as a person having the use of only one arm can easily operate the device. Further, the device is constructed of lightweight materials and can be easily disassembled into small components for transport.

A further feature of the invention involves its silent operation. Such silence in a hunting setting is crucial to the success of the hunt. The gun rest is designed to allow the marksman to silently rotate and position the gun for shot selection.

Most importantly, the invention facilitates generous movement of the firearm while the marksman assumes minimal personal displacement. The marksman can remain firmly situated in the tight deerstand and still fully position and operate the firearm to the desired shooting position and angle.

DETAILED DESCRIPTION

Figure 1:
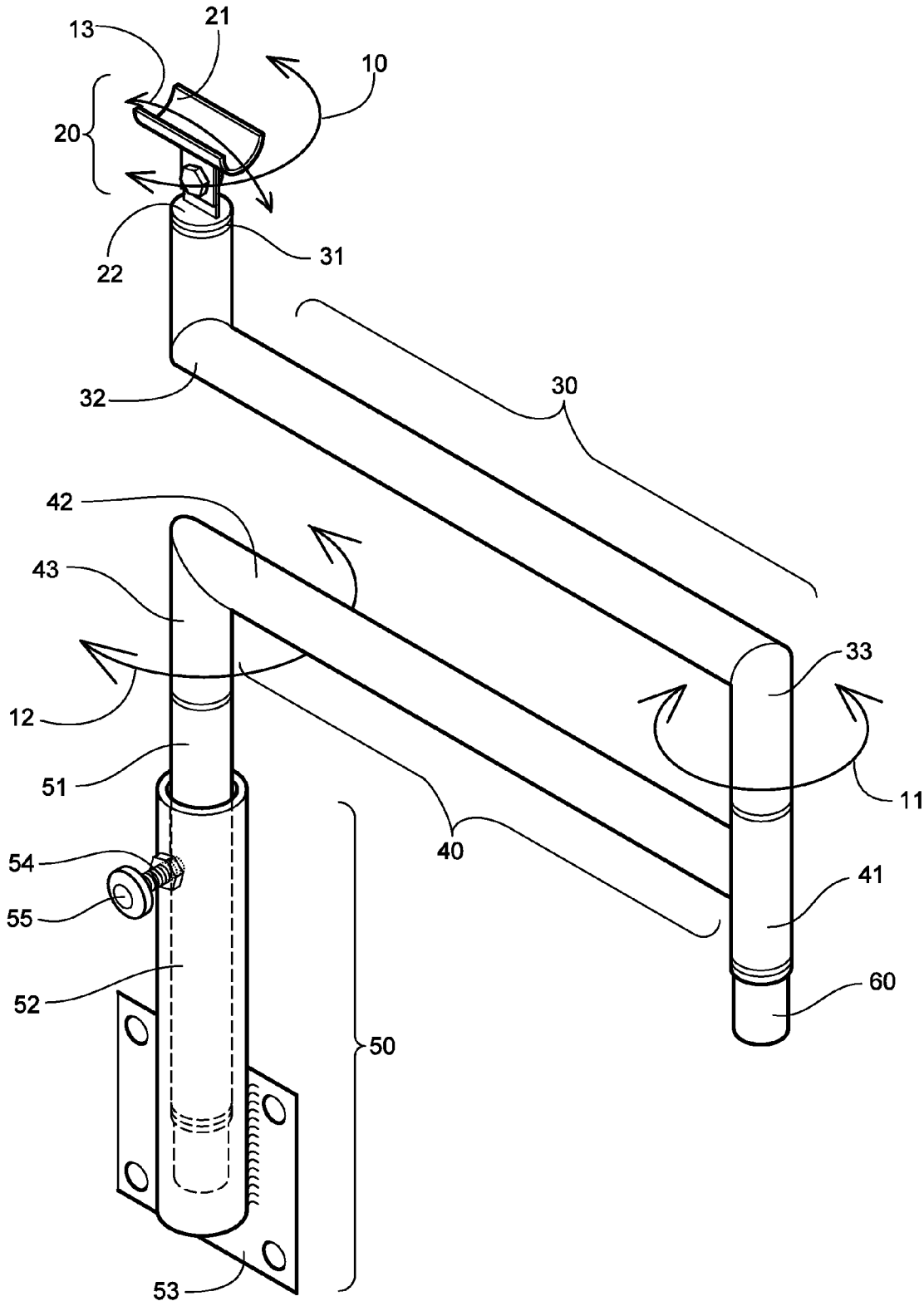
FIG. 1 is a perspective view exhibiting the diverse movement and rotation of the invention.
Figure 2:
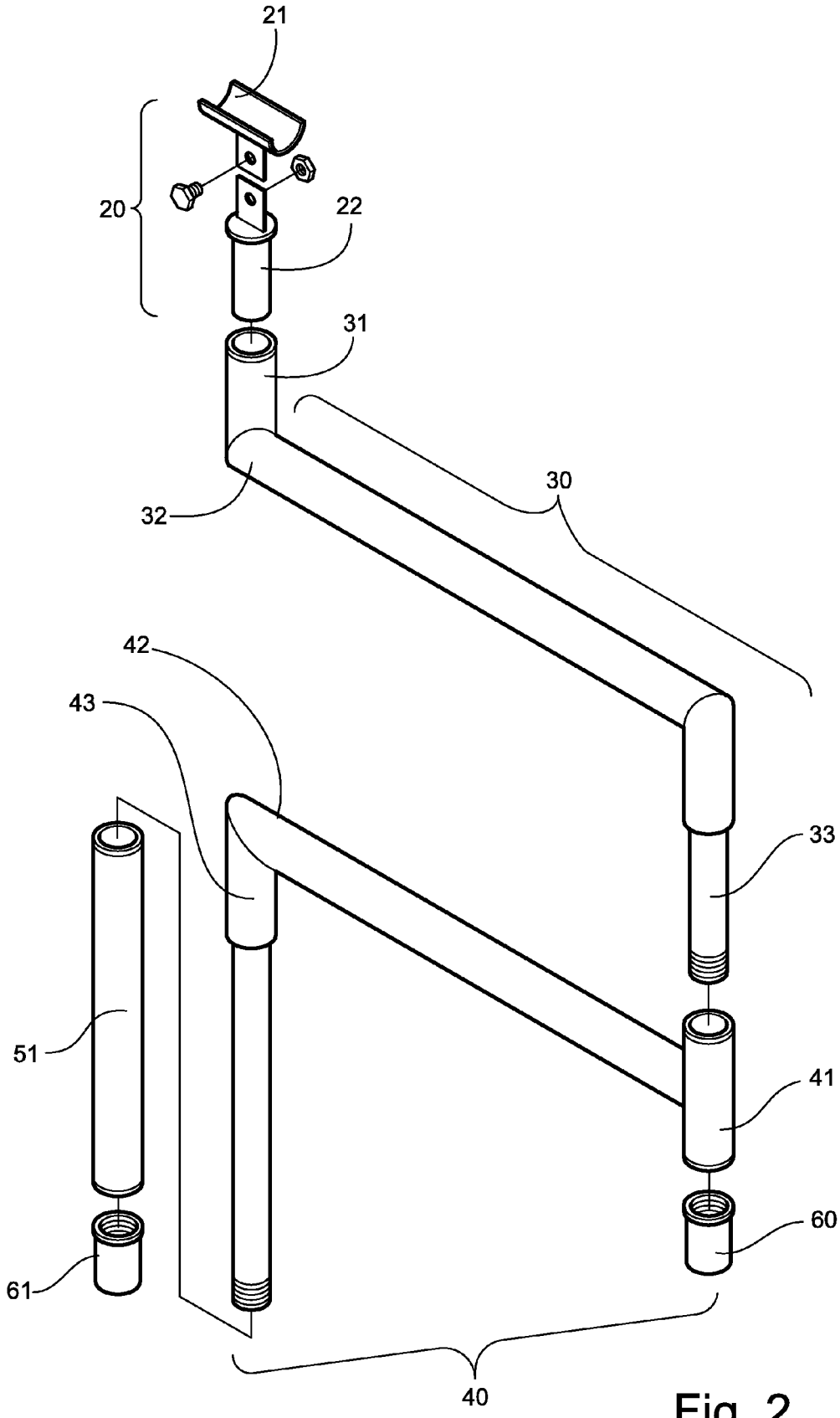
FIG. 2 is an exploded view showing the invention as pieces of a kit which can easily be put together.
Figure 3:
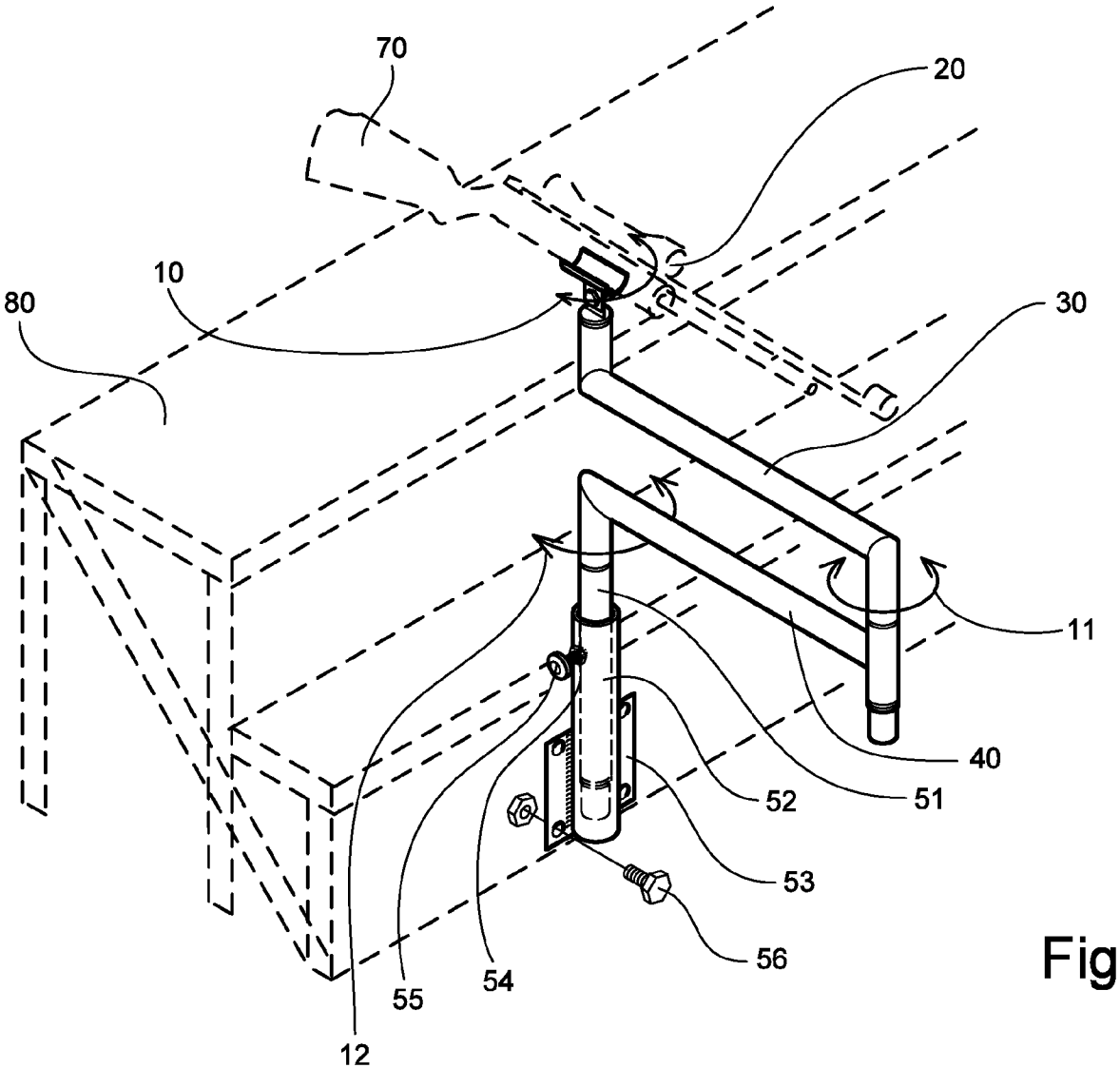
FIG. 3 is a perspective view showing one way in which the invention can be attached to an external apparatus and support a rifle.
Figure 4:
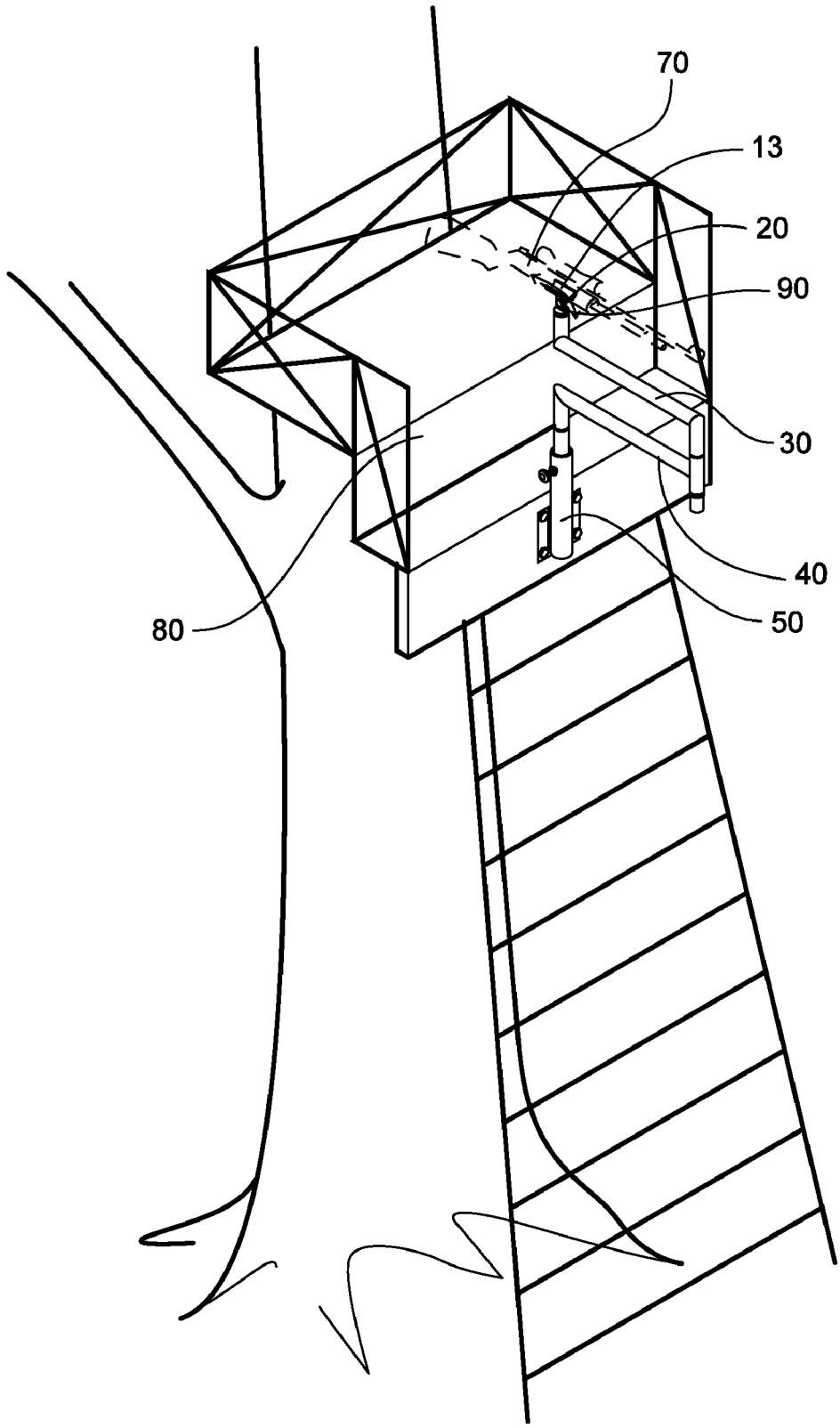
FIG. 4 is a perspective view showing the invention installed in an elevated deerstand setting.

It is to be understood by a person having ordinary skill in the art that the present discussion is a description of exemplary embodiments only, and is not intended as limiting the broader aspects of the present invention. The following example is provided to further illustrate the invention and is not to be construed to unduly limit the scope of the invention.

The present invention is a rotatable gun rest for use in a deerstand setting. The principle feature of the invention utilizes a series of parallel axis rotation points positioned along displaced elevations. In this embodiment, there are three such rotation points for producing the desired degree of gun mobility. Thus, in this embodiment, there are three parallel axes, a first axis, a second axis, and a third axis respectively. In addition to the three principle parallel axis rotation points, there is also perpendicular axis about which the gun is angled relative to the plan of the ground.

The first rotation point (10) which rotates around the first axis occurs at the connection between the U-shaped yoke member (20) and the first rotation arm member (30). The U-shaped yoke member (20) is the point of contact between the invention apparatus and the gun (70). The U-shaped yoke member (20) has a yoke (21) for receiving a gun (70) disposed at its top and an axial shaft (22) for rotatably and slidingly connecting to the first arm member (30) at its bottom. The yoke (21) of the U-shaped yoke member (20) is angled (13) to facilitate the marksman's downward aim (90) from the deerstand (80). This angle (13) is adjustable relative to the plane of the ground such that the yoke (21) is able to rotate (13) about the perpendicular axis. The axial shaft portion (22) of the U-shaped yoke member (20) is designed to fit into the sleeve portion (31) of the first rotation arm member (30) so that the U-shaped yoke member (20) can freely rotate (10) about the first axis.

The first rotation arm member (30) has the following three connected portions: a sleeve portion (21), an elongated horizontal arm portion (32), and an elongated outwardly threaded axial shaft portion (33). The sleeve portion (31) accepts the U-shaped yoke member's axial shaft portion (22) so that the U-shaped yoke member (30) can rotate (10) about the first axis. The elongated arm portion (32) separates the first axis from the second axis in aiding the mobility and positioning of the gun. The elongated outwardly threaded axial shaft portion (33) fits into and rotatably and slidingly connects to the sleeve portion (41) of the second rotation arm member (40) so that the first rotation arm member (30) can rotate (11) about the second axis. Further, the elongated outwardly threaded axial shaft portion (33) extends through the sleeve (41) of the second rotation arm member (40) so that the first inwardly threaded end cap (60) can be attached. This first end cap (60) functions to secure the first rotation arm (30) in the vertical direction yet also allow for easy assembly and disassembly.

The second rotation arm member (40) has the following three connected portions: a sleeve portion (41), an elongated horizontal arm portion (42), and an elongated outwardly threaded axial shaft portion (43). The sleeve portion (41) is open on both ends. The sleeve portion (41) accepts the first rotation arm member's axial shaft portion (33) so that the first rotation arm member (30) can rotate (11) about the second axis. The elongated arm portion (42) separates the second axis from the third axis in aiding the mobility and positioning of the gun (70). The elongated outwardly threaded axial shaft portion (43) fits into and rotatably and slidingly connects to the base sleeve (51) so that the second rotation arm member (40) can rotate (12) about the third axis. Further, the elongated outwardly threaded axial shaft portion (43) extends through the sleeve base (51) so that the second inwardly threaded end cap (61) can be attached. This second end cap (61) functions to secure the second rotation arm (40) in the vertical direction yet also allow for easy assembly and disassembly. The elongated outwardly threaded axial shaft portion (43) of the second rotation arm is somewhat longer than that same portion (33) in the first rotation arm member in order that the desired height can be adjusted by the marksman.

The base sleeve (51) is designed to be held firmly in place by a base receptacle (50). This base receptacle (50) may differ depending on the application and stand choice of the marksman but is generally attached to the deerstand (80). In the preferred embodiment, the base receptacle (50) has a various alternative means of attaching to deerstands (80). In such an embodiment the base receptacle (50) has at its bottom a base plate (53) which can be bolted (56), clamped, or welded to a deerstand. Fixedly attached to the base plate (53) is a receiver portion (52) of the base receptacle (50). In this embodiment, the receiver portion (53) is itself another sleeve which accepts the base sleeve (51) acting as an axial shaft. The base sleeve (51) can be positioned at different elevations within the receiver portion (52) of the base receptacle (50) such that the marksman can adjust the elevation of the gun (70) as desired. Once the marksman determines the desired elevation, he then adjusts a placement or set screw (54) to secure the base sleeve (51) in the base receptacle (50). The set screw (54) is operated by turning an attached set screw handle (55). When tightened, the set screw (54) places pressure on the base sleeve (51) maintaining the desired elevation.

In order to produce the silent operation contemplated by the invention, in each of the sleeve portions of the above members, namely the sleeve portion of the first rotation arm member (31), the sleeve portion of the second rotation arm member (41), and the base sleeve (51), there is machined an inner sleeve. The inner sleeve of each of these members is made of a material designed to facilitate silent operation. Such a material will have a low coefficient of friction and superior resistance to abrasion. In this embodiment, the inner sleeve is made of an Ultra High Molecular Weight Polyethylene (UHM) though products like Teflon® or other plastics could be used as well.

What is claimed is:

1. A rotatable gun rest comprising:

a yoke member further comprising a U-shaped yoke and an axial shaft, said U-shaped yoke being rotatably attached to said axial shaft and rotating about a perpendicular axis and rotating about a first parallel axis;

a first rotation arm member rotatably attached to said yoke member and rotating about a second parallel axis and further comprising a sleeve portion, an elongated horizontal arm portion, and an elongated axial shaft portion, said sleeve portion being fixedly attached to said horizontal arm portion and said elongated horizontal arm portion being fixedly attached to said elongated axial shaft portion;

a second rotation arm member rotatably attached to said first rotation arm member and rotating about a third parallel axis and further comprising a sleeve portion, an elongated horizontal arm portion, and an elongated axial shaft portion, said sleeve portion being fixedly attached to said horizontal arm portion, said elongated horizontal arm portion being fixedly attached to said elongated axial shaft portion, and said elongated axial shaft portion being longer than the elongated axial shaft portion of said first rotation arm member;

a base receptacle rotatably attached to said second rotation arm member and further comprising a base sleeve, a receiver portion, a means of attaching said base receptacle to a deerstand, and a means of adjusting the height of said rotatable gun rest, said base sleeve being rotatably attached to the elongated axial shaft portion of said second rotation arm member and removably attached to said receiver portion of said base receptacle, said means of attaching said base receptacle being fixedly attached to said receiver portion of said base receptacle, and said means of adjusting the height of said rotatable gun rest being removably attached to said receiver portion of said base receptacle;

a first end cap removably connected to the elongated axial shaft portion of said first rotation arm member; and a second end cap removably connected to the elongated axial shaft portion of said second rotation arm member.

2. The rotatable gun rest of claim 1 wherein said sleeve portion of the first rotation arm, said sleeve portion of the second rotation arm, and said base sleeve of the base receptacle are each lined with plastic for reducing friction resistance.

3. The rotatable gun rest of claim 1 wherein:

said yoke member, said first rotation arm, said second rotation arm, and said base receptacle are made of lightweight, weather resistant materials, such that the apparatus and an associated typical hunting rifle may be carried at the same time by an average human and such that the materials will resist exposure to the elements; and a camouflage coating is applied to the outer surfaces of said rotatable gun rest to avoid animal detection of said rotatable gun rest.

4. The rotatable gun rest of claim 3 wherein the first end cap is inwardly threaded; the end of said elongated axial shaft portion of said first rotation arm member is outwardly threaded; the second end cap is inwardly threaded; and the end of said elongated axial shaft portion of said second rotation arm member is outwardly threaded.

* * * * *